US010186817B2

(12) United States Patent
Paynter

(10) Patent No.: US 10,186,817 B2
(45) Date of Patent: Jan. 22, 2019

(54) RIGHT ANGLE COAXIAL CONNECTOR ASSEMBLY

(71) Applicant: CommScope Technologies LLC, Hickory, NC (US)

(72) Inventor: Jeffrey D. Paynter, Momence, IL (US)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 15/701,618

(22) Filed: Sep. 12, 2017

(65) Prior Publication Data

US 2018/0083401 A1 Mar. 22, 2018

Related U.S. Application Data

(60) Provisional application No. 62/396,954, filed on Sep. 20, 2016.

(51) Int. Cl.

| | |
|---|---|
| ***H01R 9/05*** | (2006.01) |
| ***H01R 24/54*** | (2011.01) |
| ***H01R 4/50*** | (2006.01) |
| ***H01R 24/42*** | (2011.01) |
| ***H01R 43/02*** | (2006.01) |
| *H01R 103/00* | (2006.01) |

(52) U.S. Cl.

CPC ..... *H01R 24/545* (2013.01); *H01R 4/5033* (2013.01); *H01R 9/05* (2013.01); *H01R 24/42* (2013.01); *H01R 43/02* (2013.01); *H01R 2103/00* (2013.01)

(58) Field of Classification Search

CPC ..... H01R 24/545; H01R 24/42; H01R 24/38; H01R 43/02; H01R 4/5033

USPC ..... 439/582

See application file for complete search history.

(56) References Cited

U.S. PATENT DOCUMENTS

| | | | | |
|---|---|---|---|---|
| 2,335,041 A | | 11/1943 | Bruno | |
| 2,813,144 A | * | 11/1957 | Valach | H01R 24/545 174/87 |
| 3,432,798 A | * | 3/1969 | Brishka | 439/322 |
| 4,881,912 A | * | 11/1989 | Thommen | H01R 24/566 439/582 |

(Continued)

FOREIGN PATENT DOCUMENTS

JP 2000-268908 A 9/2000

OTHER PUBLICATIONS

U.S. Appl. No. 14/303,745, Paynter et al., filed Jun. 13, 2014.

(Continued)

*Primary Examiner* — Hae Moon Hyeon

(74) *Attorney, Agent, or Firm* — Myers Bigel, P.A.

(57) ABSTRACT

A right angle coaxial connector includes: an inner contact comprising a post configured to mate with a mating coaxial cable jack, the inner contact further including a finger having a pin, the pin extending in a direction generally perpendicular to the post; an outer conductor body including a housing section and a mating ring configured to mate with the mating coaxial cable jack; a first dielectric spacer interposed between the post of the inner contact and the mating ring of the outer conductor body; and a second dielectric spacer interposed between the housing section of the outer conductor body and the finger of the inner contact. The second dielectric spacer includes a slot in which the finger and at least a portion of the pin reside.

17 Claims, 3 Drawing Sheets

(56) References Cited

U.S. PATENT DOCUMENTS

| | | | | |
|---|---|---|---|---|
| 6,017,242 | A | 1/2000 | Kerrigan | |
| 6,283,790 | B1 * | 9/2001 | Idehara | H01R 13/504 439/582 |
| 6,287,144 | B1 | 9/2001 | Baffert | |
| 6,361,348 | B1 | 3/2002 | Hall et al. | |
| 6,692,286 | B1 * | 2/2004 | De Cet | H01R 13/6277 439/350 |
| 6,860,761 | B2 | 3/2005 | Lee et al. | |
| 7,070,440 | B1 | 7/2006 | Zerebilov et al. | |
| 7,207,839 | B1 | 4/2007 | Shelly et al. | |
| 7,419,403 | B1 * | 9/2008 | Paynter | H01R 9/0521 439/578 |
| 7,458,850 | B1 | 12/2008 | Burris et al. | |
| 7,530,841 | B2 * | 5/2009 | Henningsen | H01R 24/545 439/578 |
| 7,621,778 | B1 * | 11/2009 | Paynter | H01R 9/0521 439/584 |
| 8,206,176 | B2 * | 6/2012 | Islam | H01R 13/565 439/578 |
| 9,054,471 | B2 * | 6/2015 | Hosler, Sr. | H01R 24/542 |
| 9,287,658 | B2 | 3/2016 | Lewin | |
| 2001/0034159 | A1 * | 10/2001 | Pitschi | H01R 9/05 439/583 |
| 2004/0137790 | A1 | 7/2004 | Lee et al. | |
| 2007/0254518 | A1 | 11/2007 | Nealle | |
| 2008/0293298 | A1 | 11/2008 | Burris et al. | |
| 2009/0186522 | A1 | 7/2009 | Henningsen | |
| 2011/0076885 | A1 | 3/2011 | Shaw et al. | |
| 2014/0199886 | A1 | 7/2014 | Nugent | |
| 2014/0370747 | A1 | 12/2014 | Vaccaro et al. | |
| 2015/0118898 | A1 | 4/2015 | Paynter et al. | |
| 2016/0226202 | A1 * | 8/2016 | Paynter | H01R 9/05 |

OTHER PUBLICATIONS

International Search Report and Written Opinion for corresponding PCT Application No. PCT/US2016/015312, dated Apr. 29, 2016, 12 pages.

Notification Concerning Transmittal of International Preliminary Report on Patentability for corresponding PCT Application No. PCT/US2016/015312, dated Aug. 17, 2017.

Notification of Transmittal of the International Search Report and the Written Opinion of the International Searching Authority, or the Declaration corresponding to International Application No. PCT/US2017/051043, dated Dec. 20, 2017.

* cited by examiner

RIGHT ANGLE COAXIAL CONNECTOR ASSEMBLY

RELATED APPLICATION

The present application claims priority from and the benefit of U.S. Provisional Patent Application No. 62/396,954, filed Sep. 20, 2016, the disclosure of which is hereby incorporated herein in its entirety.

FIELD OF THE INVENTION

The present invention is directed generally to electrical cable connectors, and more particularly to coaxial connectors for electrical cable.

BACKGROUND OF THE INVENTION

Coaxial cables are commonly utilized in RF communications systems. A typical coaxial cable includes an inner conductor, an outer conductor, a dielectric layer that separates the inner and outer conductors, and a jacket that covers the outer conductor. Coaxial cable connectors may be applied to terminate coaxial cables, for example, in communication systems requiring a high level of precision and reliability.

Coaxial connector interfaces provide a connect/disconnect functionality between (a) a cable terminated with a connector bearing the desired connector interface and (b) a corresponding connector with a mating connector interface mounted on an apparatus or on another cable. Typically, one connector will include an inner contact, such as a pin or post connected to an inner conductor and an outer conductor connector body connected to the outer conductor; these are mated with a mating sleeve (for the pin or post of the inner conductor) and another outer conductor connector body of a second connector. Coaxial connector interfaces often utilize a threaded coupling nut or other retainer that draws the connector interface pair into secure electro-mechanical engagement when the coupling nut (which is captured by one of the connectors) is threaded onto the other connector.

Although many coaxial connectors are configured to be oriented "in line" with their attached cables (i.e., such that the inner contact is generally coaxial with the inner conductor of the cable), some coaxial connectors are configured such that the inner contact is oriented generally perpendicular to the attached cable. These so-called "right angle" connectors can raise different issues than inline connectors when being manufactured and/or attached to a cable due to their geometry.

SUMMARY

As a first aspect, embodiments of the invention are directed to a right angle coaxial connector comprising: an inner contact comprising a post configured to mate with the inner conductor body of a mating coaxial cable jack, the inner contact further including a finger having a pin, the pin extending in a direction generally perpendicular to the post; an outer conductor body including a housing section and a mating ring configured to mate with the outer conductor body of the mating coaxial cable jack; a first dielectric spacer interposed between the post of the inner contact and the mating ring of the outer conductor body; and a second dielectric spacer interposed between the housing section of the outer conductor body and the finger of the inner contact.

The second dielectric spacer includes a slot in which the finger and at least a portion of the pin reside.

As a second aspect, embodiments of the invention are directed to a right angle coaxial connector comprising: an inner contact comprising a post configured to mate with the inner conductor body of a mating coaxial cable jack, the inner contact further including a finger having a pin, the pin extending in a direction generally perpendicular to the post; an outer conductor body including a housing section and a mating ring configured to mate with the outer conductor body of the mating coaxial cable jack; a first dielectric spacer interposed between the post of the inner contact and the mating ring of the outer conductor body; and a second dielectric spacer interposed between the housing section of the outer conductor body and the finger of the inner contact. The second dielectric spacer includes a slot in which the finger and at least a portion of the pin reside. The outer conductor body includes a feature that the first dielectric spacer to locate the pin in a desired axial position.

As a third aspect, embodiments of the invention are directed to a method of constructing a right-angle coaxial connector, comprising the steps of:

(a) providing an outer conductor body having a housing section and a mating ring;
(b) providing an inner contact and a first dielectric spacer, the inner contact having a post, a finger and a pin that is generally perpendicular to the post;
(c) inserting a second dielectric spacer into the housing section of the outer conductor body, the second dielectric spacer having an axial slot;
(d) engaging the outer conductor body and the second dielectric spacer with a fixture, the fixture having a recess to receive the outer conductor body and a post that extends into the slot, the fixture orienting the second dielectric spacer in a desired orientation relative to the outer conductor body;
(e) inserting the inner contact and the first dielectric spacer through the mating ring into the housing section; the finger and pin being received in the slot; and
(f) attaching the pin to an inner conductor of a coaxial cable.

DETAILED DESCRIPTION OF EMBODIMENTS OF THE INVENTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the above description is for the purpose of describing particular embodiments only and is not intended to be limiting of the invention. As used in this disclosure, the singular forms "a", "an" and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
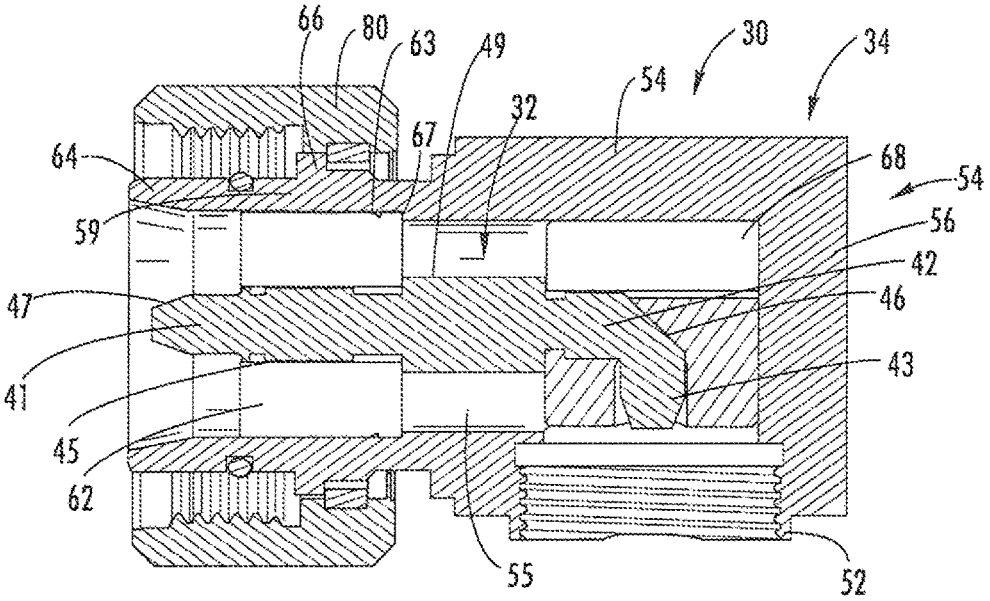
FIG. 1 is a side section view of a right-angle coaxial connector according to embodiments of the present invention.
Figure 2:
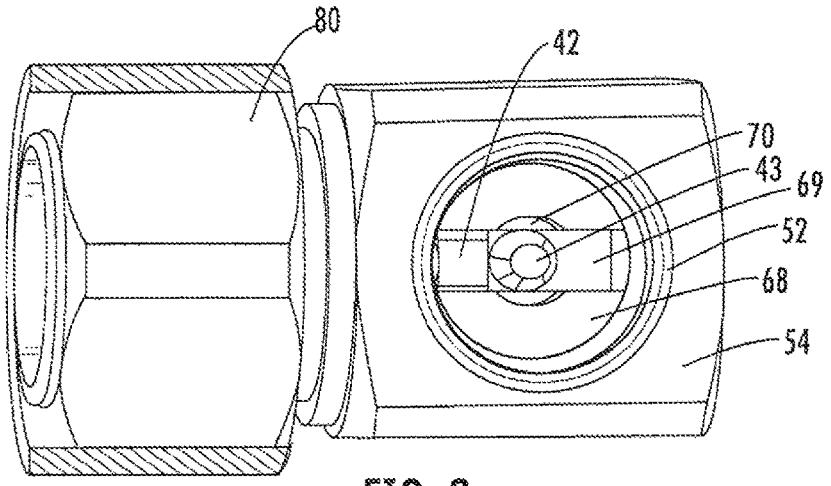
FIG. 2 is a bottom view of the connector of FIG. 1.

Referring now to the drawings, a right angle plug, designated broadly at 30, is shown in FIGS. 1 and 2. The plug 30 is to be attached to a conventional coaxial cable having an inner conductor, a dielectric layer that circumferentially overlies the inner conductor, an outer conductor that circumferentially overlies the dielectric layer, and a polymeric cable jacket that circumferentially overlies the outer conductor. These components will be well-known to those of skill in this art and need not be described in detail herein. The plug 30 is described in detail below.

Referring again to FIG. 1, the plug 30 includes an inner contact 32 and an outer conductor body 34. As can be seen in FIG. 1, the inner contact 32 is generally cylindrical and comprises a post 41 with a flared tip 47 that is configured to mate with the inner conductor body of a mating jack. A ridge 49 extends radially outwardly from the center portion of the post 41. A finger 42 extends from the opposite end of the ridge 49. A pin 43 extends perpendicularly from the end of the finger 42. A mitered surface 46 faces upwardly and rearwardly.

Referring still to FIG. 1, the outer conductor body 34 includes a threaded cable contact sleeve 52. A housing section 54 rests atop the cable contact sleeve 52. The housing section 54 includes side walls 55, a rear wall 56, and a ceiling 57. A connector contact section 59 extends away from the housing section 54 opposite the rear wall 56. An annular mating ring 64 extends away from the housing section 54 and is configured to mate with a mating jack. A circular flange 66 extends radially outwardly from the connector contact section 59 and provides a bearing surface for interaction with a coupling nut 80 and/or a retaining clip.

A first, or front, dielectric spacer 62 fills an inner portion of the connector contact section 59 and maintains physical and electrical separation of the inner contact 32 and the outer conductor body 34. The first dielectric spacer 62 provides a bearing surface that abuts a shoulder 67 (or other axial alignment feature) of the housing section 54. Also, a burr 63 extends radially inwardly from the housing section 54 to provide an anti-rotation feature between the first dielectric spacer 62 and the outer conductor body 34. Similarly, a burr 45 extends radially outwardly from the inner contact 32 to provide an anti-rotation feature between the inner contact 32 and the first dielectric spacer 62.

A second, or rear, dielectric spacer 68 is located within the housing section 54. The second, or rear, dielectric spacer 68 is generally cylindrical, but includes a slot 69 that extends parallel with the axis of the rear spacer 68. As can be seen in FIG. 1, the finger 42 of the inner contact 32 fits within and extends parallel to the slot 69, with the pin 43 slightly extending out of the slot 69. A circular pocket 70 is recessed from the slot 69 (see FIG. 2).

The presence of the second dielectric spacer 68 can assist in the proper alignment of the finger 42 and pin 43 and the inner conductor of an attached coaxial cable (not shown). During assembly of right angle radio frequency (RF) connectors, aligning the right angle pin with the inner conductor of the attached coaxial cable can be difficult, especially if the post 41 is locked in position by the first dielectric spacer 62 and/or the outer conductor body 34 by one or more burrs or other anti-rotation features. The second dielectric spacer 68 can provide a registration feature (in the form of the axial slot 69) to accept and align the finger 42 and the pin 43 relative to the outer conductor body 34, and in particular to the cable contact sleeve 52.

Figure 3:
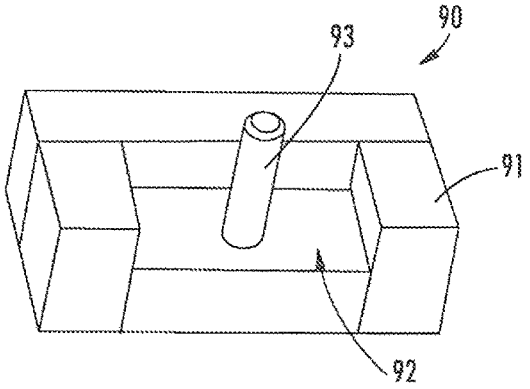
FIG. 3 is a perspective view of a fixture used in the assembly of the connector of FIG. 1.
Figure 4A:
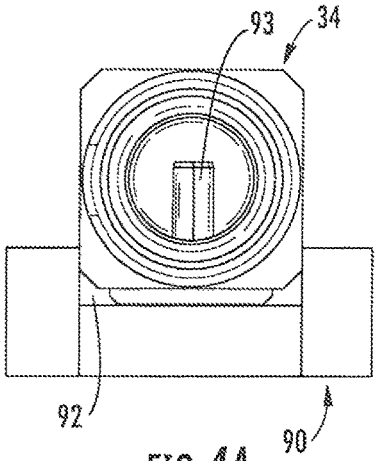
FIG. 4A is an end view of the outer conductor body of the connector of FIG. 1 nested in the fixture of FIG. 3.
Figure 4B:
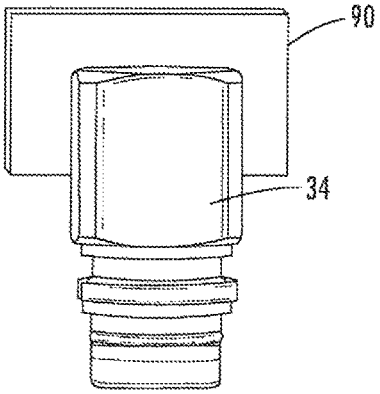
FIG. 4B is a top view of the outer connector body and fixture of FIG. 4A.
Figure 5:
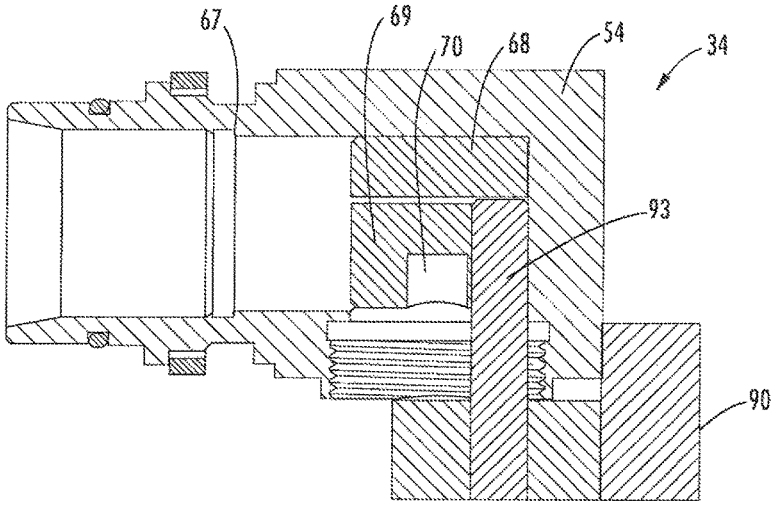
FIG. 5 is a side section view of the outer conductor body and fixture of FIG. 4A with the second dielectric spacer in position.
Figure 6:
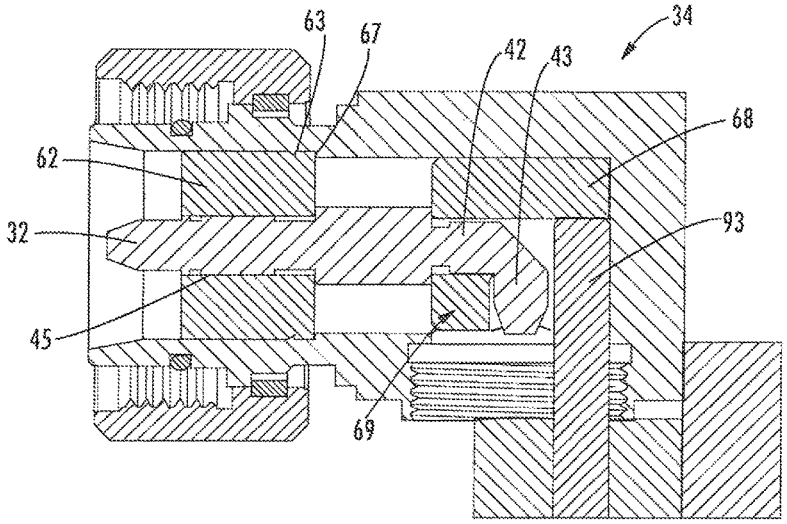
FIG. 6 is a side section view as in FIG. 5 with the inner contact and first dielectric spacer inserted into the outer conductor body.

During assembly of the connector 30, the outer conductor body 34 and the second dielectric spacer 68 are secured with a fixture 90. As can be seen in FIG. 3, the fixture 90 has a generally rectangular body 91 with a recess 92 and a fixture post 93 that extends from the recess 92 above the surface of the body 91. The outer body 34 fits within the recess 92 of the fixture 90 (see FIGS. 4A and 4B). The second dielectric spacer 68 is inserted into the housing section 54 of the outer body 34, with the second dielectric spacer 68 rotated within housing section 54 of the outer body 34 to align the slot 69 with the fixture post 93 (see FIG. 5). The inner contact 32 and first dielectric spacer 62 (which are typically already assembled as a single unit) are then inserted so that the finger 42 rides in the slot 69 of the second dielectric spacer 68 (FIG. 6). Movement of the inner contact 32 ceases when the rear end of the first dielectric spacer 62 contacts the shoulder 67 of the outer body 34. The slot 69 in the second dielectric spacer 68 angularly locates the finger 42 and pin 43, and the shoulder 67 and first dielectric spacer 62 axially align the pin 43, which is now in coaxial alignment with the cable contact sleeve 52 of the outer body 34. The fixture 90 can then be withdrawn. The burr 45 maintains the orientation of the finger 42 and pin 43 (and, in turn, the second dielectric spacer 68) so that the alignment is maintained during handling and shipping.

Those of skill in this art will appreciate that, although the plug 30 is illustrated herein, a jack or other connector may be suitable for use with the concepts discussed above. Also, although a galvanic connection is anticipated between the plug 30 and a mating jack, the concepts discussed herein may be employed with connectors designed for capacitive coupling (see, e.g., U.S. patent application Ser. No. 14/303,745, filed Jun. 13, 2014, the disclosure of which is hereby incorporated herein in its entirety). Moreover, the connection between (a) the pin 43 and the inner conductor of a coaxial cable and/or (b) the cable contact sleeve 52 of the outer body and the outer conductor of a coaxial cable can be achieved in any conventional manner, including both galvanic and capacitive interfaces.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A right angle coaxial connector comprising:

an inner contact comprising a post configured to mate with a mating coaxial cable jack, the inner contact further including a finger having a pin, the pin extending in a direction generally perpendicular to the post;

an outer conductor body including a housing section and a mating ring configured to mate with the mating coaxial cable jack;

a first dielectric spacer interposed between the post of the inner contact and the mating ring of the outer conductor body; and a second dielectric spacer interposed between the housing section of the outer conductor body and the finger of the inner contact;

wherein the second dielectric spacer includes a slot in which the finger and at least a portion of the pin reside.

2. The coaxial connector of claim 1, wherein the outer conductor body is a monolithic component.

3. The coaxial connector of claim 1, wherein the inner contact includes a burr extending radially outwardly to prevent the first dielectric spacer from rotating relative to the inner contact.

4. The coaxial connector of claim 1, wherein the outer conductor body includes a burr extending radially inwardly to prevent the first dielectric spacer from rotating relative to the outer conductor body.

5. The coaxial connector of claim 1, wherein the outer conductor body includes a shoulder that engages a bearing surface of the first dielectric spacer to locate the inner contact in a desired axial position.

6. The coaxial connector of claim 1, in combination with a fixture configured to interact with the second dielectric spacer and the inner contact to position the pin for interconnection with an inner conductor of a coaxial cable.

7. A right angle coaxial connector comprising:

an inner contact comprising a post configured to mate with a mating coaxial cable jack, the inner contact further including a finger having a pin, the pin extending in a direction generally perpendicular to the post;

an outer conductor body including a housing section and a mating ring configured to mate with the mating coaxial cable jack;

a first dielectric spacer interposed between the post of the inner contact and the mating ring of the outer conductor body; and a second dielectric spacer interposed between the housing section of the outer conductor body and the finger of the inner contact;

wherein the second dielectric spacer includes a slot in which the finger and at least a portion of the pin reside; and wherein the outer conductor body includes a feature that enables the first dielectric spacer to locate the pin in a desired axial position.

8. The coaxial connector of claim 7, wherein the outer conductor body is a monolithic component.

9. The coaxial connector of claim 7, wherein the inner contact includes a burr extending radially outwardly to prevent the first dielectric spacer from rotating relative to the inner contact.

10. The coaxial connector of claim 7, wherein the outer conductor body includes a burr extending radially inwardly to prevent the first dielectric spacer from rotating relative to the outer conductor body.

11. The coaxial connector of claim 7, in combination with a fixture configured to interact with the second dielectric spacer and the inner contact to position the pin for interconnection with an inner conductor of a coaxial cable.

12. A method of constructing a right-angle coaxial connector, comprising the steps of:

(a) providing an outer conductor body having a housing section and a mating ring;

(b) providing an inner contact and a first dielectric spacer, the inner contact having a post, a finger and a pin that is generally perpendicular to the post;

(c) inserting a second dielectric spacer into the housing section of the outer conductor body, the second dielectric spacer having an axial slot;

(d) engaging the outer conductor body and the second dielectric spacer with a fixture, the fixture having a recess to receive the outer conductor body and a fixture post that extends into the slot, the fixture orienting the second dielectric spacer in a desired orientation relative to the outer conductor body;

(e) inserting the inner contact and the first dielectric spacer through the mating ring into the housing section; the finger and pin being received in the slot; and (f) attaching the pin to an inner conductor of a coaxial cable.

13. The method of claim 12, wherein the outer conductor body is a monolithic component.

14. The method of claim 12, wherein the inner contact includes a burr extending radially outwardly to prevent the first dielectric spacer from rotating relative to the inner contact.

15. The method of claim 12, wherein the outer conductor body includes a burr extending radially inwardly to prevent the first dielectric spacer from rotating relative to the outer conductor body.

16. The method of claim 12, wherein the outer conductor body includes a shoulder that engages a bearing surface of the first dielectric spacer during step (e) to locate the pin in a desired axial position.

17. The method defined in claim 12, wherein the inner contact and the first dielectric spacer are fixed relative to each other prior to step (e).

* * * * *